US007389767B2

(12) United States Patent
Käsbauer et al.

(10) Patent No.: US 7,389,767 B2
(45) Date of Patent: Jun. 24, 2008

(54) METHOD FOR DIAGNOSIS OF A VOLUME FLOW CONTROL VALVE IN AN INTERNAL COMBUSTION ENGINE COMPRISING A HIGH-PRESSURE ACCUMULATOR INJECTION SYSTEM

(75) Inventors: Michael Käsbauer, Neutraubling (DE); Wolfgang Stadler, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 398 days.

(21) Appl. No.: 10/527,976

(22) PCT Filed: May 13, 2004

(86) PCT No.: PCT/EP2004/050790

§ 371 (c)(1),
(2), (4) Date: Apr. 11, 2005

(87) PCT Pub. No.: WO2005/001264

PCT Pub. Date: Jan. 6, 2005

(65) Prior Publication Data

US 2006/0243244 A1 Nov. 2, 2006

(30) Foreign Application Priority Data

Jun. 30, 2003 (DE) ..... 103 29 331

(51) Int. Cl.
*F02M 69/54* (2006.01)
*G01L 3/26* (2006.01)

(52) U.S. Cl. ..... 123/457; 123/333; 123/456; 73/116; 73/118.1

(58) Field of Classification Search ..... 123/333, 123/456, 457; 73/116, 118.1
See application file for complete search history.

(56) References Cited

U.S. PATENT DOCUMENTS 6,578,553 B1 * 6/2003 Schubert et al. ..... 123/458
7,171,952 B2 * 2/2007 Joos et al. ..... 123/457

FOREIGN PATENT DOCUMENTS

DE 38 08 382 A1 9/1989
DE 195 20 300 A1 12/1996
DE 196 04 552 A1 8/1997

(Continued)

*Primary Examiner*—Stephen K. Cronin
*Assistant Examiner*—J. Page Huffy
(74) *Attorney, Agent, or Firm*—Laurence A. Greenberg; Werner H. Stemer; Ralph E. Locher

(57) ABSTRACT

The invention relates to an internal combustion engine comprising a high-pressure accumulator injection system wherein the swept volume and the pressure are regulated by means of a volume flow control valve (VCV) and a pressure control valve (PCV). The inventive method consists in checking, during the overrun condition of the internal combustion engine, whether predetermined release conditions for carrying out the diagnosis are fulfilled, and in the event of a positive result, the control valve (VCV) is closed for a predetermined period of time (t1). During said period (t1), values relating to fuel pressure (FUP) are detected by means of the pressure sensor (21) and compared with a predetermined threshold value (FUP-SW), the control valve (VCV) being deemed faultless if said fuel pressure (FUP) values are sufficiently often below the threshold value (FUP_SW) during the cited period of time (t1).

13 Claims, 3 Drawing Sheets

FOREIGN PATENT DOCUMENTS

Figure 1:
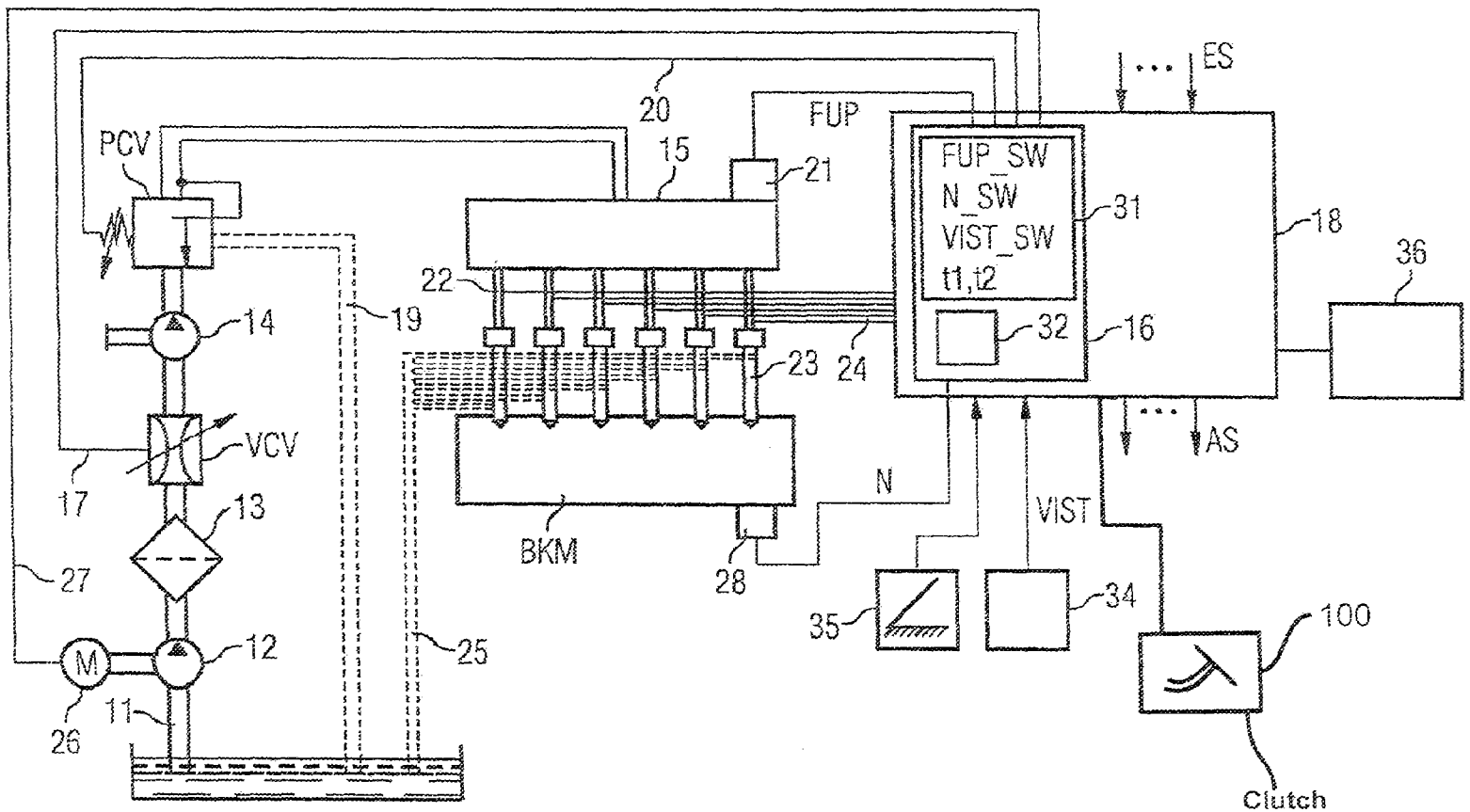

| | | | | |
|---|---|---|---|---|
| DE | 100 43 688 | A1 | | 3/2002 |
| DE | 100 61 855 | A1 | | 8/2002 |
| DE | 101 44 800 | A1 | | 4/2003 |
| EP | 0 886 056 | A1 | | 12/1998 |
| EP | 1 310 655 | A2 | | 5/2003 |
| JP | 11082248 | A | * | 3/1999 |
| WO | 98/45594 | | | 10/1998 |

* cited by examiner

METHOD FOR DIAGNOSIS OF A VOLUME FLOW CONTROL VALVE IN AN INTERNAL COMBUSTION ENGINE COMPRISING A HIGH-PRESSURE ACCUMULATOR INJECTION SYSTEM

DESCRIPTION

Method for diagnosis of a volume flow control valve in an internal combustion engine comprising a high-pressure accumulator injection system

BACKGROUND OF THE INVENTION

FIELD OF THE INVENTION

The invention relates to a method for diagnosis of a volume flow control valve in an internal combustion engine comprising a high-pressure accumulator injection system. Fuel is delivered by a pre-feed pump and a high-pressure pump to a high-pressure accumulator to which at least one injector for injecting the fuel into at least one cylinder of the internal combustion engine is connected, with a pressure sensor assigned to the high-pressure accumulator and of a pressure regulation control valve for setting the pressure in the high-pressure accumulator on the basis of the fuel pressure signal delivered by the pressure sensor.

High-pressure accumulator injection systems are increasingly being used for supplying fuel to internal combustion engines. Such injection systems are known as common-rail systems for diesel engines and as HPDI (High Pressure Direct Injection) systems for gasoline engines. These injection systems feature components such as a pre-feed pump, high-pressure pump, fuel filter, pressure control valve, volume flow control valve, high-pressure accumulator, injectors (injection valves) and associated lines.

The pre-feed pump delivers fuel from a fuel storage tank via the fuel filter to the high-pressure pump. This compresses the fuel and feeds it under high pressure into the high-pressure accumulator (common rail), from where the injectors on the individual cylinders are supplied. The opening and closing of the injectors is generally controlled electrically or electromagnetically.

As well as for pressurized storage, the high-pressure accumulator is also used to smooth out pressure pulses, for which a sufficiently large storage volume is necessary.

The volume flow control valve is used for demand-dependent setting of the volume flow of the high-pressure pump. With the aid of the pressure control valve the pressure in the high-pressure accumulator is set in accordance with the operating conditions of the internal combustion engine.

In addition to the electrical diagnosis of components of such a high-pressure accumulator injection system, plausibility checking is also an important instrument for detecting operational faults. In particular pressure variations can occur in the high-pressure accumulator in the above system if the volume flow control valve is not working correctly. This can adversely affect driving characteristics and lead to higher exhaust gas emissions.

The occurrence of pressure oscillations can have causes other than a volume flow control valve which is not working correctly and is therefore not uniquely attributable to a defective volume flow control valve.

SUMMARY OF THE INVENTION

The object of the invention is to specify a method by which a defective volume flow control valve can be easily detected during the operation of the internal combustion engine.

This object is achieved by the features of Patent Claim 1.

For an internal combustion engine with a high-pressure accumulator injection system, in which the swept volume and the pressure are set by means of a volume flow control valve and a pressure control valve, a check is made during the overrun condition of the internal combustion engine as to whether predetermined release conditions for performing the diagnosis are fulfilled, and if the result of the check is positive, the pressure control valve is closed for a predetermined length of time (diagnostic time). During the diagnostic period values for the fuel pressure are detected by means of the pressure sensor on the high-pressure accumulator and these values are compared with predetermined threshold value for the fuel pressure. The control valve is classified as fault free if the values for the fuel pressure within the diagnostic period are below the threshold value sufficiently often.

It is especially advantageous for the pressure control valve to be able to be opened briefly at the same time that the volume flow control valve is being closed. This achieves a rapid and defined pressure reduction.

Advantageously one or more of the following parameters are evaluated as release conditions for diagnosis:

In particular an inquiry is made as to whether the fuel-injection is switched off (overrun mode), the speed of the internal combustion engine lies above a predetermined threshold value and the speed of the vehicle lies above a predetermined threshold value, the clutch is engaged and there is no request from the driver. To this end the signals from various sensors and generators are evaluated.

In order not to falsify the diagnosis the diagnosis is aborted immediately if during the diagnosis period one of the release conditions is no longer fulfilled.

Furthermore it is possible for the diagnosis to only be performed once per driving cycle or at predetermined intervals respectively, provided the activation conditions were fulfilled for a sufficient length of time.

Further advantageous embodiments of the method in accordance with the invention are specified in the subclaims.

The invention is explained in greater detail below with reference to the drawing. The drawing shows:

BRIDF DESCRIPTION OF THE DRAWING

Figure 2:
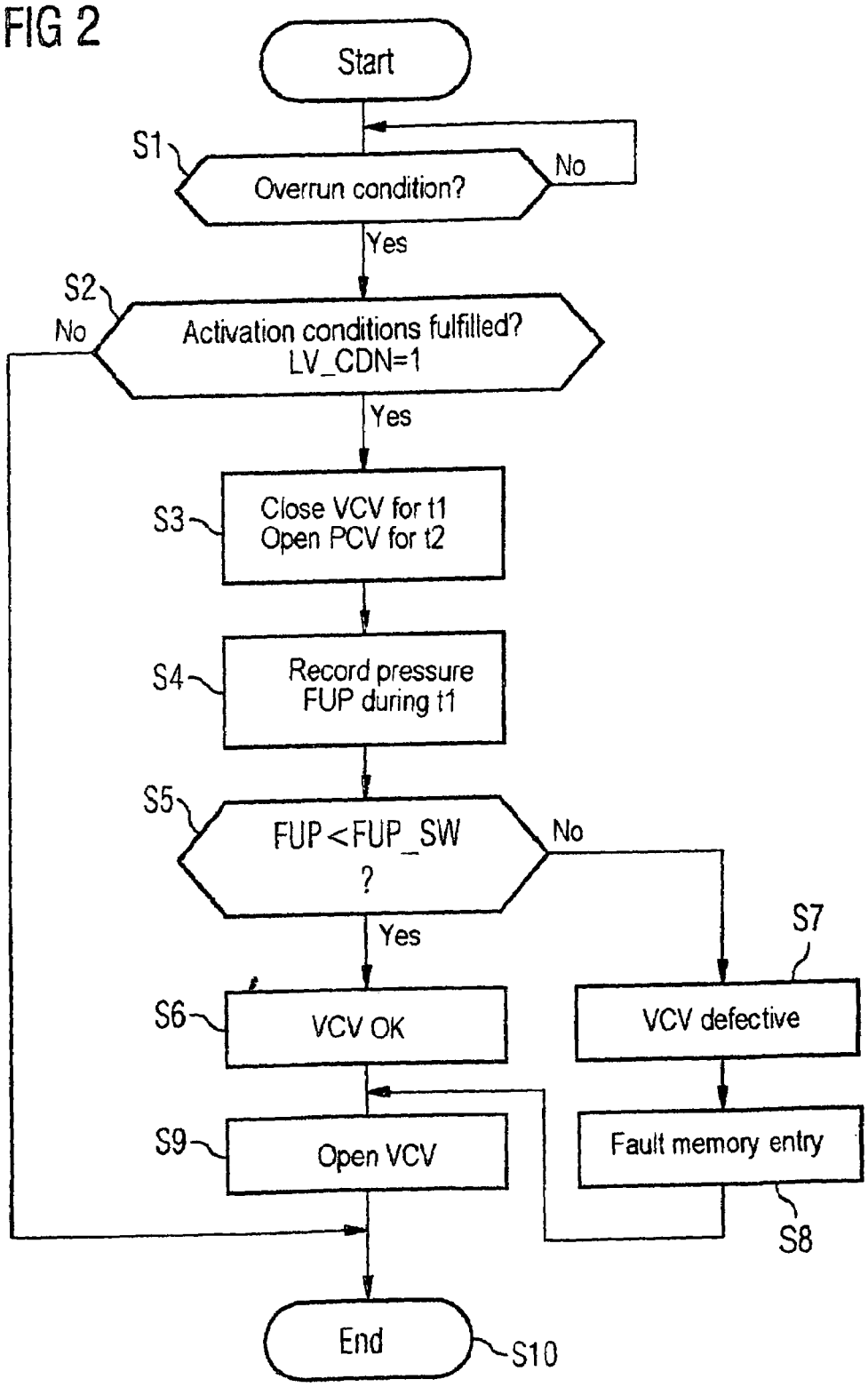
Figure 3:
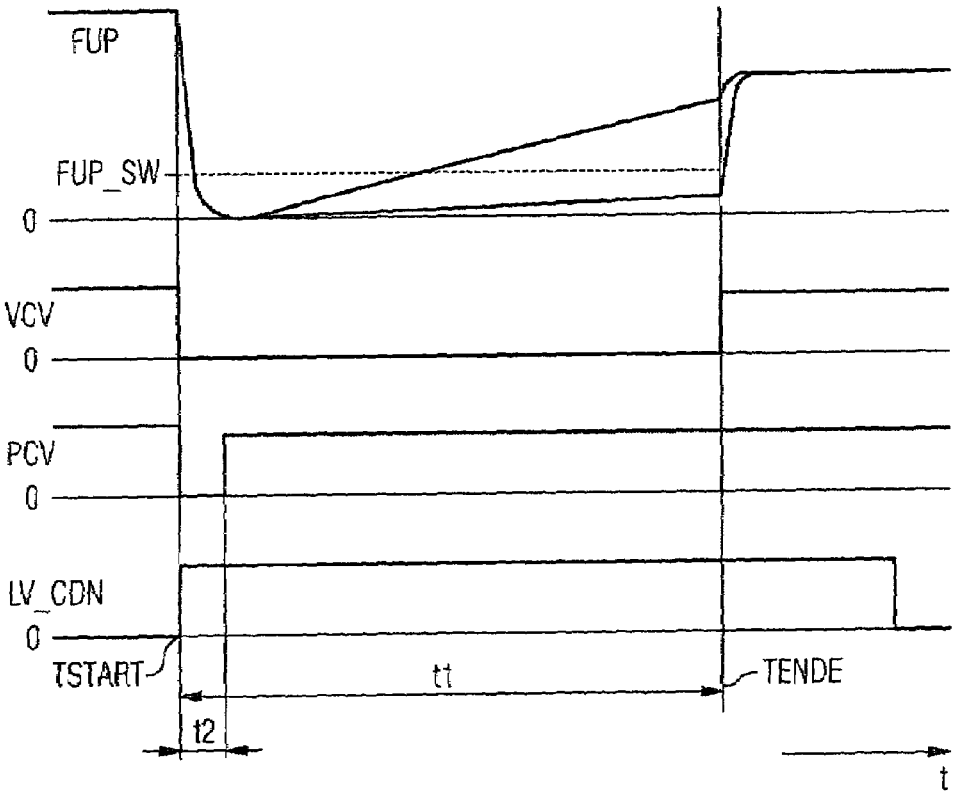

FIG. 1 a schematic diagram of an injection system for an internal combustion engine operating with the direct fuel injection, FIG. 2 A flowchart of the method in accordance with the invention and FIG. 3 a diagram for selected signal curves.

DESCRIPTION OF THE PREFERRED EMBODIMENTS

FIG. 1 shows a schematic diagram of the structure of a fuel-injection system for an internal combustion engine BKM operating with direct fuel injection, as is used under the name of common rail system above all in vehicles with diesel engines. In this diagram only those components are shown which are needed for the understanding of the invention.

With this injection system fuel is drawn out of a fuel storage tank 10 via a fuel line 11 through a pre-feed pump 12. The pre-feed pump 12 delivers the fuel via a fuel filter 13 to a high-pressure pump 14 which compresses the fuel and feeds it under high pressure into a high-pressure accumulator 15 known as the rail. This high-pressure accumulator 15, in addition to storing the fuel under pressure, also has the important task of smoothing out pressure variations by a sufficiently high storage volume.

To enable the volume flow of the high-pressure pump 14 to be set in the high-pressure accumulator 15 in accordance with the relevant operating conditions of the internal combustion engine BKM according to demand, an additional throttle valve, referred to below as the volume flow control valve VCV, is arranged in the fuel line 11 between the pre-feed pump 12 and the high-pressure pump 14. With the aid of this valve the delivery flow of the high-pressure pump 14 can be controlled. This volume flow control valve VCV is controlled by a control unit 16 via a control line 17. The control unit 16 is a preferably integrated into an electronic control device 18 of the internal combustion engine which controls and/or regulates all the execution sequences needed to operate the internal combustion engine BKM. To this end a plurality of input signals ES recorded by means of the corresponding sensors are fed to the control device 18 of the internal combustion engine BKM. Via output signal AS the individual actuators and components are activated which are necessary for the operation of the internal combustion engine BKM. The control unit 16 features a timer 32 as well as a memory 31 in which various threshold values FUP SW, N _SW, VIST SW and times t1, t2 are stored for which the meaning will be explained in greater detail below with reference to the description of FIGS. 2 and 3. Furthermore an error memory 36 is assigned to the control unit 16 and the control device 18.

To enable the pressure in the high-pressure accumulator 15 to be set in accordance with the desired operating conditions of the internal combustion engine BKM, a pressure control valve PCV is also connected into the fuel line 11 after the high-pressure pump 14. This pressure control valve PCV controls and/or regulates excess fuel returned to the fuel storage tank 10 via a fuel return line 19 shown by a dashed line in the diagram which would not be needed to maintain the desired pressure in the high-pressure accumulator 15, with the holding pressure of the pressure control valve PCV being set by the control unit 16 via a control line 20. A pressure sensor 21 is also provided for controlling the pressure in the high-pressure accumulator 15. This pressure sensor 21 is used to detect the fuel pressure FUP currently obtaining in the high-pressure accumulator 15 on the basis of which the control unit 16, in accordance with the desired operating conditions of the internal combustion engine BKM, controls the pressure via the pressure control valve PCV.

Fuel pressures of between 0 and 1650 bar can be set in the high-pressure accumulator 15 the aid of the arrangement shown. These fuel pressures obtain over fuel injection lines 22 at injectors 23 (injection valves) which directly inject fuel into the combustion chambers of the internal combustion engine BKM on demand. These injectors 23 generally feature an injection nozzle connected to a needle under spring pressure. The injection process is initiated by the control unit 16 which is connected via control lines 24 to the injectors 23. The leakage flow occurring in the injectors 23 is directed via fuel return lines 25 shown as dashed lines in the diagram into the fuel storage tank 10.

An engine speed sensor 28 is also provided on the internal combustion engine BKM which sends a signal corresponding to the revolutions N of the crankshaft of the internal combustion engine to the control unit 16 for further processing. The signal VIST of a speed sensor 34, as well as the signal of a pedal sensor module 35 are also fed to the control device 18. The latter is used to transfer the driver's wishes.

The pre-feed pump 12 is driven in a preferred embodiment via an electric motor 26 which is connected via a control line 27 to the control unit 16. Furthermore this type of electrically driven pre-feed pump 12 can also be designed so that its speed can be regulated.

The pre-feed pump 12 and the high-pressure pump 14 can also be driven by the internal combustion engine BKM and the speeds of the pumps are then set with a fixed transmission ratio proportional to the speed of the internal combustion engine. The pre-feed pump 12 is here preferably integrated into the housing of the high-pressure pump 14.

Furthermore it is also possible to drive the high-pressure pump 14 independently of the speed of the internal combustion engine BKM, for example by means of an electric motor.

When the internal combustion engine BKM is switched off, the pressure control valve PCV is opened in order to let the fuel out of the high-pressure accumulator. The volume flow control valve VCV remains open for a short time after the internal combustion engine BKM is turned off during the re setting of the control unit 16 to refill the pump chamber of the high pressure pump 14. Thus, the next time that the internal combustion engine BKM is started, the filling of this dead space is dispensed with, which leads to the high-pressure accumulator injection system being ready for operation more quickly.

in a preferred embodiment the pressure control valve PCV is open with zero current, i.e. when the internal combustion engine BKM is switched off it is isolated. The volume flow control valve VCV is closed with zero current so that after expiry of the reset time by switching off the power supply the fuel feed line 11 to the high-pressure pump 14 is interrupted If the power supply fails both valves thus assume a safe state.

The flowchart shown in FIG. 2 and the timing diagram of selected signals shown in FIG. 3 are used to illustrate how the volume flow control valve VCV can be tested to see whether it is functioning correctly. In the diagram according to FIG. 3 from top to bottom, the relevant curves over time t for the fuel pressure FUP, the ON/OFF state of the volume flow control valve VCV and of the pressure control valve PCV and also the state of the flags LV CDN are plotted.

In a first procedural step S1 a check is made as to whether the internal combustion engine BKM is in the overrun mode (fuel injection switched off, overrun cutoff), that is in a load state in which negative work is being done, meaning that the internal combustion engine is not doing work but is consuming it. If an overrun condition does not obtain in the internal combustion engine, the inquiry in procedural step S1 is negative, so that no checking routine for the volume flow control valve VCV is started and this inquiry is executed repeatedly. Else, in a procedural step S2, a check is made as to whether further release conditions for checking the volume flow control valve VCV are fulfilled. In particular an inquiry is made about whether the speed N of the internal combustion engine is above a predetermined threshold value N_SW the speed of the vehicle VIST is above a predetermined threshold value VIST SW, the clutch 100 is engaged and the driver is not making any requests. This involves evaluation of signals such as those of sensors 34 and of the pedal sensor module 35.

If one of the conditions is not fulfilled, a flag (marker) LV CDN=0 is set and the procedure is ended (procedural step S10). If however these conditions are fulfilled, in a procedural step S3 the flag LV CDN=1 is set, and via corresponding signals the volume flow control valve VCV is closed at starting time TSTART for a predetermined time t1 (diagnostic time). To achieve a rapid and defined pressure reduction in the injection system, the pressure control valve PCV is opened for a predetermined time t2<t1 simultaneously with time TSTART. This latter step is not absolutely necessary, but makes diagnosis more definite. After time t2 has elapsed the pressure control valve PCV is activated again and thereby a specific holding pressure set. The holding pressure is selected for example as a function of the speed N of the internal combustion engine. The volume flow control valve VCV however remains closed.

The times t1, t2 are determined experimentally through trials and are stored in the memory 31 of control unit 16. These times t1, t2 are controlled and monitored by timer 32.

Measurements of the fuel pressure FUP now allow assessment of whether the volume flow control valve VCV can be activated.

Immediately after the closure of the volume flow control valve VCV the fuel pressure FUP drops very quickly. During the time t1 the fuel pressure FUP is constantly recorded by means of the pressure sensor 21 (procedural step S4) and compared to a predetermined threshold value FUP SW (procedural step S5). If the fuel pressure FUP remains within the time t1 sufficiently often below the threshold value FUP SW, in a procedural step S6 the volume flow control valve VCV is classified as fault-free, else as defective (procedural step S7) and a corresponding entry is made in the fault memory 36 (procedural step S8). At the same time the result, at least in the case of a faulty volume flow control valve VCV, can be indicated to the driver audibly and/or visually. The inquiry about the fuel pressure FUP in the rail 15 by means of the pressure sensor 21 is appropriately filtered to exclude any disturbances.

After the complete diagnosis sequence (time TENDE) the volume flow control valve VCV will be opened again by means of signals of the control unit 16 (procedural step S9). The degree of opening can in this case preferably be selected as a function of the speed N of the internal combustion engine BKM. The procedure is then ended (procedural step S10).

If during diagnosis the flag changes to LV CDN=0, for example caused by a request from the driver and recorded by the pedal sensor module 35, this leads to the diagnosis being aborted immediately. In this case any pressure variations which might occur could falsify the result of the diagnosis.

In addition it is also possible, to only allow the diagnosis to be performed completely once per driving cycle or at specific intervals, provided the activation conditions were fulfilled for a sufficient length of time.

We claim:

1. A method for diagnosis of a fuel volume control valve for setting a fuel volume flow in an internal combustion engine, the method which comprises:

providing a fuel system with a pre-feed pump, a high-pressure pump for feeding fuel to a high-pressure accumulator, a fuel control valve for setting a volumetric flow of the fuel fed by the high-pressure pump to the high-pressure accumulator, at least one injector for injecting the fuel into at least one cylinder of the internal combustion engine connected to the high-pressure accumulator, a pressure sensor assigned to the high-pressure accumulator, and a pressure control valve for setting a pressure in the high-pressure accumulator based on a fuel pressure signal from the pressure sensor;

in overrun mode of the internal combustion engine, performing a check whether release conditions for executing the diagnosis are fulfilled, the release conditions selected from a group consisting of whether a speed of the internal combustion engine lies above a first predetermined threshold value, whether a speed of the vehicle driven by way of the internal combustion engine lies above a second predetermined threshold value, whether a clutch of the vehicle is engaged, and whether there is not a request from a driver of the vehicle; and if a result of the inquiry is positive, closing the volume control valve for a predetermined period of time;

during the period of time, recording values for the fuel pressure by way of the pressure sensor;

comparing the values for the fuel pressure with a predetermined threshold value;

if the values for the fuel pressure within the time period are below the threshold value sufficiently often, classifying the volume control valve as fault-free; and otherwise classifying the volume control valve as defective.

2. The method according to claim 1, wherein one of the release conditions is whether the speed of the internal combustion engine lies above the first predetermined threshold value.

3. The method according to claim 1, wherein one of the release conditions is whether the speed of the vehicle driven by way of the internal combustion engine lies above the second predetermined threshold value.

4. The method according to claim 1, wherein one of the release conditions is whether the clutch of the vehicle is engaged.

5. The method according to claim 1, wherein one of the release conditions is whether there is not the request from the driver of the vehicle.

6. The method according to claim 1, which comprises:

selecting the release conditions to include whether the speed of the internal combustion engine lies above the first predetermined threshold value, whether the speed of the vehicle driven by way of the internal combustion engine lies above the second predetermined threshold value, whether the clutch of the vehicle is engaged, and whether there is not the request from the driver of the vehicle; and aborting the diagnosis if, during the time period, at least one of the release conditions is no longer fulfilled.

7. The method according to claim 1, which comprises aborting the diagnosis if, during the time period, at least one of the release conditions is no longer fulfilled.

8. The method according to claim 1, which comprises performing the diagnosis once per driving cycle.

9. The method according to claim 1, which comprises executing the diagnosis at predetermined intervals, provided all activation conditions have been fulfilled for a sufficient length of time.

10. The method according to claim 1, which comprises, concurrently with closing the volume control valve, briefly opening the pressure control valve for a time shorter than the period of time, and subsequently setting the pressure control valve to a specific hold pressure for a remainder of the period of time.

11. The method according to claim 1, which comprises experimentally determining the threshold value for the fuel pressure and storing the experimentally determined data in a memory of a control unit.

12. The method according to claim 2, which comprises experimentally determining the threshold value for the speed of the internal combustion engine and storing the experimentally determined data in a memory of a control unit.

13. The method according to claim 3, which comprises experimentally determining the threshold value for the speed of the vehicle and storing the experimentally determined data in a memory of a control unit.

* * * * *